US006347721B1

(12) United States Patent
Vine

(10) Patent No.: US 6,347,721 B1
(45) Date of Patent: Feb. 19, 2002

(54) HINGED COVER FOR A DISPOSABLE CUP DISPENSER

(76) Inventor: Menacham Vine, 8 Basht Street, Telz Stone, D.N. Harei Yehuda, 90838 (IL)

( * ) Notice: Subject to any disclaimer, the term of this patent is extended or adjusted under 35 U.S.C. 154(b) by 0 days.

(21) Appl. No.: 09/615,223

(22) Filed: Jul. 13, 2000

(30) Foreign Application Priority Data

Jul. 23, 1999 (IL) ..... 131067

(51) Int. Cl.[7] ..... B65D 43/16
(52) U.S. Cl. ..... 220/831; 220/836; 220/840
(58) Field of Search ..... 220/831, 832, 220/836, 840, 843, 844, 254, 256, 259, 845, 4.03

(56) References Cited

U.S. PATENT DOCUMENTS

| | | | | |
|---|---|---|---|---|
| 183,971 | A | * | 10/1876 | Rasin |
| 2,826,780 | A | * | 3/1958 | Dorfman |
| 3,841,528 | A | * | 10/1974 | Eisenberg |
| 5,014,878 | A | | 5/1991 | Janz |
| 5,395,015 | A | * | 3/1995 | Bolen, Jr. et al. |
| 5,427,273 | A | * | 6/1995 | Vine |
| 5,884,803 | A | * | 5/1999 | Vine |

FOREIGN PATENT DOCUMENTS

| | | | |
|---|---|---|---|
| WO | WO94/26611 | * | 11/1994 |

OTHER PUBLICATIONS

Search Report from Irish Patent Office, dated Apr. 14, 2001.

* cited by examiner

*Primary Examiner*—Nathan J. Newhouse
(74) *Attorney, Agent, or Firm*—Rockey, Milnamow & Katz, Ltd.

(57) ABSTRACT

The invention provides a cover for a tubular feed container for a disposable cup dispenser, the cover comprising an annular base sized to concentrically override an upper area of the tubular container in friction-fit engagement therewith, and a hinged lid attached to a pair of spaced-apart hinge flanges protruding from an outer surface of the base, wherein an edge of the lid bracketed by the pair of hinges is provided with a concave configuration complementary to the convex curvature of the outer surface of the annular base, and an upper surface area of the lid is provided with a concave depression complementary in configuration to the convex curvature of the outer surface of the annular base, whereby the lid can be rotated about the hinges in an arc of about 270° from a first position atop the base to a second position with the upper surface of the lid substantially flush with an outer portion of the annular base, without damage to the hinges.

3 Claims, 2 Drawing Sheets

HINGED COVER FOR A DISPOSABLE CUP DISPENSER

The present invention relates to a hinged cover for a tubular feed container of disposable cups.

In U.S. Pat. Nos. 5,427,273 and 5,884,803 the present applicant has disclosed a dispenser for disposable cups. Such dispensers hold disposable cups in a stacked column, the lowest cup of the stack being exposed so that it can be gripped by hand and removed when required for use.

The cup column is protected against dirt and inadvertent dispersal by a tubular member which is advantageously transparent.

The top of said tubular member must be closed to prevent the entry of dirt, yet provision for re-loading cups must be retained. In FIG. 5a of U.S. Pat. No. 5,427,273 the open top of the tubular member is sealed by means of a removable lid, which allows recharging. In FIG. 5b the top is permanently closed by a dome, and recharging requires removal of the tubular member. Both options have been found to have some disadvantages. The removable lid may be lost, and total removal of the domed tubular member during recharging could be a somewhat troublesome for the unskilled personnel likely to service a device of this type.

A hinged cover was thus considered to provide a satisfactory solution. However most covers of this type open 180° or less, with the result that a force applied to the cover exceeding the hinge operating range will break the hinge. Dispensers are often situated in public areas, and hinge breakage could result either inadvertently or due to vandalism.

Hinged covers have of course been known for many decades. Recent U.S. patents offer typical examples.

In U.S. Pat. No. 4,441,624 Sokolowski discloses a cover for a beverage container hinged about the upper rim of the container. Clearly, opening the cover too far will cause its separation from the container.

Stover et al disclose a hinged cover for a coffee-making and dispensing machine in U.S. Pat. No. 4,676,150. The coffee reservoir has its cover hinged to allow the cover to be simultaneously tilted upwards and be lifted off the reservoir; this then permits removal of the reservoir from the cabinet. Such an arrangement would not be suitable for the present application.

It is therefore one of the objects of the present invention to obviate the disadvantages of prior art hinged covers and to provide an arrangement which will not over-stress the hinge even if the cover is opened to its extreme.

It is a further object of the present invention to provide a cover for the disposable cup stack tube of a cup dispenser which is retained by the tubular container and allows fast recharge thereof.

A further problem unique to disposable cup dispensers is that they need to be designed to be affixed to a water cooler, as well as to be affixed to a wall surface.

According to prior art constructions, in order to provide a dispenser designed to be a affixed to a water cooler in which the hinge can open 270° it is necessary to use large extended hinges, however said hinges are not aesthetic and for such a cup dispenser to be attached to a wall surface and to properly open at least 90° it is necessary to either increase the amount of plastic used in the base so that the dispenser can be further removed from the wall surface to which it is attached and/or to provide a large protruding bracket for said hinges of said cover to achieve this effect.

It is therefore an object of the present invention to provide a cover for a tubular feed container for a disposable cup dispenser which is aesthetic, without large protruding hinges, and which does not require a massive base and/or bracket for distancing from a wall surface to which it is attached, while enabling the same cup dispenser to be affixed to a water cooler, wherein the preferred opening would be an angle of 270°, while also being adapted for affixation to a wall surface with an unobstructed opening of 90°.

The present invention achieves the above objects by providing a cover for a tubular feed container for a disposable cup dispenser, said cover comprising an annular base sized to concentrically override an upper area of said tubular container in friction-fit engagement therewith, and a hinged lid attached to a pair of spaced-apart hinge flanges protruding from an outer surface of said base. An edge of the lid is bracketed by said pair of hinges, and is provided with a concave configuration complementary to the convex curvature of the outer surface of said annular base. An upper surface area of the lid is provided with a concave depression complementary in configuration to the convex curvature of the outer surface of the annular base, whereby said lid can be rotated about its hinges in an arc of about 270° from a first position atop said base to a second position with the upper surface of the lid substantially flush with an outer portion of the annular base, without damage to the hinges.

In a preferred embodiment of the present invention said concave depression tapers in width from said edge towards the center of the lid.

It will thus be realized that the novel device of the present invention serves to allow full opening of the cover without hinderance by any part of the tubular container or base. When fully open the cover contacts the base over a wide area well distanced from the hinge center, so that the hinge is not subjected to abuse. The container can be easily recharged after opening the cover, and the cover is retained against loss.

In especially preferred embodiments of the present invention the distance from said outer surface of said annular base and a vertical plane passing through the axis of the hinge is less than the distance from an uppermost surface of said lid and a horizontal plane passing through the axis of said hinge.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
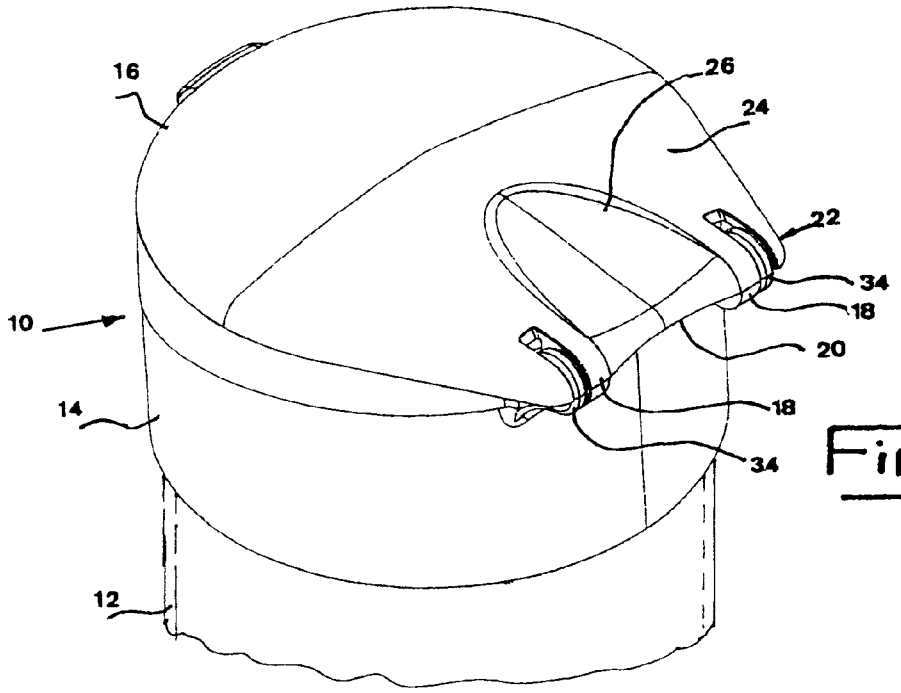
FIG. 1 is a perspective view of a preferred embodiment of the cover according to the invention, the cover being shown in its closed position.

There is seen in FIG. 1 a cover 10 for a tubular feed container 12 for a disposable cup dispenser, not shown. The dispenser has been described in U.S. Pat. Nos. 5,427,273 and 5,884,803.

The lower portion of the cover 10 comprises an annular base 14 sized to concentrically override an upper area of a tubular container 12 in friction-fit engagement therewith. However, should the base 14 be loose on the container 12 due to manufacturing variations, adhesive attachment can be used.

Figure 3:
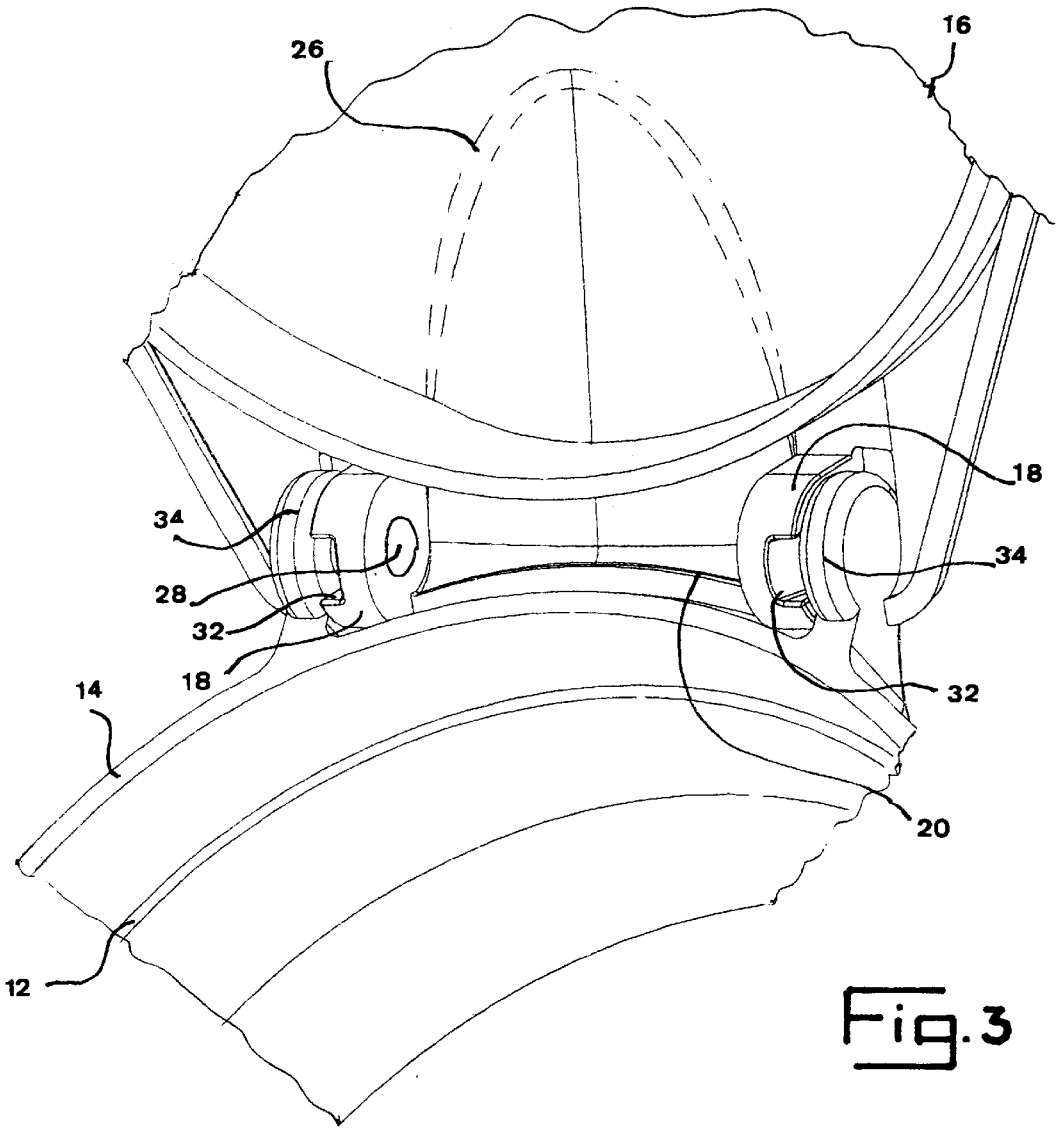
FIG. 3 is a perspective detail view of the hinge.

A hinged lid 16 is attached to a pair of spaced-apart hinge flanges 18 which in turn are pivoted to flanges 34 protruding from an outer surface of the base 14. An edge 20 of the lid 16, seen to better effect in FIG. 3, is bracketed by the pair of hinges 22. The edge 20 is provided with a concave configuration complementary to the convex curvature 21 of the outer surface of the annular base 14, so allowing the lid 16 to be opened without rubbing or damaging engagement with or against the base 14.

Figure 2:
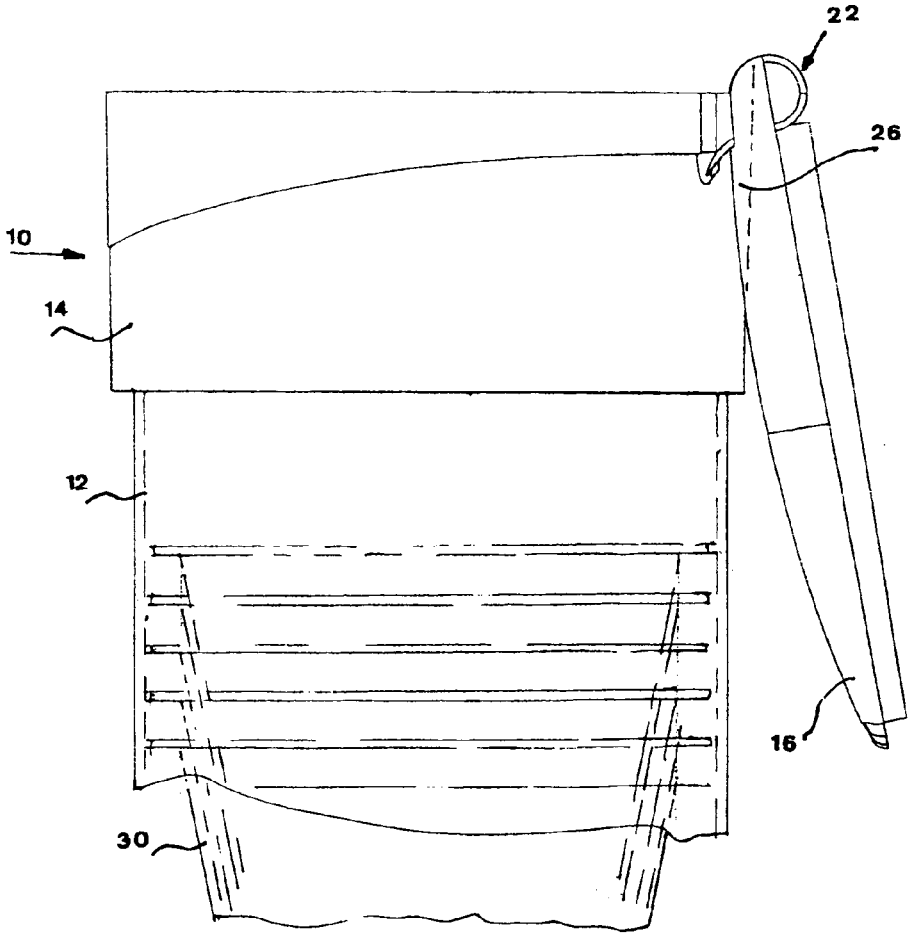
FIG. 2 is a side elevational view of the same cover in its maximum open position.

An upper surface area 24 of the lid 16 is provided with a concave depression 26 complementary in configuration to the convex curvature 21 of the outer surface of the annular base 14. Preferably the concave depression 26 tapers in width from the edge 20 towards the center of the lid 16. The depression 26 makes possible lid rotation about its hinges 22 in an arc of about 270°, from a first position atop base 14, as seen in FIG. 1, to a second position as seen in FIG. 2, with the upper center surface of lid 16 now substantially flush with an outer portion of the annular base 14. Even if the lid 16 is pressed hard against the base 14, no damage to the hinges 22 results.

The lid 16 can be manufactured as a unitary plastic molding, including the hinge pins 28, seen in FIG. 3, projecting from the hinge flanges 18 as seen in FIG. 3. Suitable plastics are ABS, polyethylene, acrylic, nylon and PVC, etc. The annular base 14 can be made of the same materials.

Referring now to FIG. 2, there is seen the same embodiment in a fully open position. Due to the depression 26, the upper surface of lid 16 is, at its center, substantially flush with an outer portion of annular base 14, Hand pressure on the lid will be resisted by the base 14 without damage to the hinges 22, due to the substantial support provided by the base 14 at a distance from the hinge 22.

A stack of disposable cups 30 is seen in the tubular container 12.

FIG. 3 illustrates hinge details of the same embodiment. The recesses 32 seen in the inner flanges 18 connected to the lid 16 allow passage during assembly for integral hinge pins 28 which are molded together with the outer flanges 34 which are part of the annular base 14. Recesses 32 allow the use of more rigid plastics which would be damaged by excessive deflection during the assembly operation.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A cover for a tubular feed container for a disposable cup dispenser, said cover comprising an annular base sized to concentrically override an upper area of said tubular container in friction-fit engagement therewith, and a hinged lid attached to a pair of spaced-apart hinge flanges protruding from an outer surface of said base, wherein an edge of said lid bracketed by said pair of hinges is provided with a concave configuration complementary to the convex curvature of the outer surface of said annular base, and an upper surface area of said lid is provided with a concave depression complementary in configuration to the convex curvature of the outer surface of said annular base, whereby said lid can be rotated about said hinges in an arc of about 270° from a first position atop said base to a second position with the upper surface of said lid substantially flush with an outer portion of said annular base, without damage to said hinges.

2. A cover according to claim 1, wherein said concave depression tapers in width from said edge towards the center of said lid.

3. A cover according to claim 1, wherein the distance from said outer surface of said annular base and a vertical plane passing through the axis of the hinge is less than the distance from an uppermost surface of said lid and a horizontal plane passing through the axis of said hinge.

* * * * *